US009039362B2

(12) United States Patent
Fukuda et al.

(10) Patent No.: US 9,039,362 B2
(45) Date of Patent: May 26, 2015

(54) IMPELLER AND CENTRIFUGAL FAN USING THE SAME

(75) Inventors: Takako Fukuda, Nagano (JP); Seiya Fujimoto, Nagano (JP); Masaki Ogushi, Nagano (JP); Yuzuru Suzuki, Nagano (JP)

(73) Assignee: Minebea Co., Ltd., Nagano (JP)

( * ) Notice: Subject to any disclaimer, the term of this patent is extended or adjusted under 35 U.S.C. 154(b) by 573 days.

(21) Appl. No.: 13/408,106

(22) Filed: Feb. 29, 2012

(65) Prior Publication Data

US 2013/0058783 A1 Mar. 7, 2013

(30) Foreign Application Priority Data

Mar. 14, 2011 (JP) ..... 2011-055360
Mar. 30, 2011 (JP) ..... 2011-074339

(51) Int. Cl.
*F04D 29/44* (2006.01)
*F04D 29/42* (2006.01)
*F04D 25/06* (2006.01)
(Continued)

(52) U.S. Cl.
CPC ..... *F04D 29/441* (2013.01); *F04D 29/4246* (2013.01); *F04D 25/0613* (2013.01); *F04D 29/059* (2013.01); *F04D 29/281* (2013.01); *F04D 29/30* (2013.01)

(58) Field of Classification Search
CPC ..... F04D 29/281; F04D 29/2216; F04D 29/2222; F04D 29/4226; F04D 29/059; F04D 29/30; F04D 29/441; F04D 29/4246; F04D 25/0613
USPC ..... 415/206, 185, 186, 203; 416/223 R, 416/242, 186 R, 243
See application file for complete search history.

(56) References Cited

U.S. PATENT DOCUMENTS 3,140,042 A * 7/1964 Fujii ..... 416/243
3,261,297 A * 7/1966 Daniel ..... 415/204
(Continued)

FOREIGN PATENT DOCUMENTS

JP S55-134797 A 10/1980
JP H05-039799 A 2/1993
(Continued)

OTHER PUBLICATIONS

JP11-148495, English machine translation, translated by ProQuest Sep. 3, 2014.*
(Continued)

*Primary Examiner* — Nathaniel Wiehe
*Assistant Examiner* — Wayne A Lambert
(74) *Attorney, Agent, or Firm* — Carrier Blackman & Associates, P.C.; Joseph P. Carrier; Anne G. Sabourin

(57) ABSTRACT

An impeller includes: a main plate; a shroud; and a plurality of blades provided between the main plate and the shroud and arranged circumferentially; wherein the impeller is configured to rotated about a rotation axis; wherein the plurality of blades include a pressure surface and a negative pressure surface; and the pressure surface has a shape, in which at least three types of circular arcs are connected, as viewed from a rotation axial direction. A centrifugal fan includes the above-described impeller; and three or more pillars, wherein an interval between one adjacent pillars of the three or more pillars is different from an interval between the other adjacent pillars of the three or more pillars.

1 Claim, 17 Drawing Sheets

(51) Int. Cl.

| | |
|---|---|
| ***F04D 29/059*** | (2006.01) |
| ***F04D 29/28*** | (2006.01) |
| ***F04D 29/30*** | (2006.01) |

(56) References Cited

U.S. PATENT DOCUMENTS

| | | | | |
|---|---|---|---|---|
| 3,627,442 | A * | 12/1971 | Brandt | 415/206 |
| 4,165,950 | A * | 8/1979 | Masai et al. | 416/178 |
| 4,208,169 | A * | 6/1980 | Becker et al. | 416/185 |
| 4,531,890 | A * | 7/1985 | Stokes | 416/187 |
| 4,543,041 | A * | 9/1985 | French et al. | 416/183 |
| 4,647,271 | A * | 3/1987 | Nagai et al. | 416/186 R |
| 4,666,373 | A * | 5/1987 | Sugiura | 416/185 |
| 4,695,228 | A * | 9/1987 | Purcaru | 416/223 A |
| 4,795,312 | A * | 1/1989 | Purcaru | 416/223 A |
| 5,288,203 | A * | 2/1994 | Thomas | 165/80.3 |
| 5,559,674 | A * | 9/1996 | Katsui | 361/697 |
| 5,940,267 | A * | 8/1999 | Katsui et al. | 361/697 |
| 5,979,541 | A * | 11/1999 | Saito | 165/80.3 |
| 6,007,300 | A * | 12/1999 | Saeki et al. | 416/178 |
| 6,261,051 | B1 * | 7/2001 | Kolacny | 415/53.3 |
| 6,503,055 | B1 | 1/2003 | Gerenski et al. | |
| 6,616,409 | B2 * | 9/2003 | Bradbury et al. | 416/223 R |
| 6,685,433 | B2 * | 2/2004 | Kim et al. | 416/186 R |
| 6,739,835 | B2 * | 5/2004 | Kim | 416/186 R |
| 6,799,948 | B2 * | 10/2004 | Ito et al. | 416/223 A |
| 6,884,033 | B2 * | 4/2005 | Liao | 415/206 |
| 7,063,504 | B2 * | 6/2006 | Huang et al. | 415/165 |
| 7,210,904 | B2 * | 5/2007 | Chandraker | 415/206 |
| 7,223,075 | B2 * | 5/2007 | Schmitt | 416/185 |
| 7,351,032 | B2 * | 4/2008 | Horng et al. | 415/213.1 |
| 7,744,350 | B2 * | 6/2010 | Ogino et al. | 416/178 |
| 7,845,900 | B2 * | 12/2010 | Roduner et al. | 415/127 |
| 7,909,571 | B2 | 3/2011 | Wu et al. | |
| 7,967,575 | B2 | 6/2011 | Teshima et al. | |
| 8,011,891 | B2 | 9/2011 | Ochiai et al. | |
| 8,016,556 | B2 | 9/2011 | Teshima et al. | |
| 2003/0063974 | A1 * | 4/2003 | Hsieh | 416/182 |
| 2003/0077177 | A1 * | 4/2003 | Rossi et al. | 416/223 R |
| 2003/0223864 | A1 * | 12/2003 | Horng et al. | 415/203 |
| 2004/0076516 | A1 * | 4/2004 | Bird | 415/206 |
| 2005/0152781 | A1 * | 7/2005 | Baek et al. | 415/206 |
| 2007/0160478 | A1 * | 7/2007 | Jarrah et al. | 416/223 R |
| 2007/0212219 | A1 * | 9/2007 | Teshima et al. | 415/206 |
| 2008/0107523 | A1 * | 5/2008 | Chen et al. | 415/206 |
| 2009/0142196 | A1 * | 6/2009 | Gerhardt et al. | 416/223 R |
| 2010/0209264 | A1 * | 8/2010 | Takemoto et al. | 417/366 |
| 2010/0303647 | A1 | 12/2010 | Ida et al. | |

FOREIGN PATENT DOCUMENTS

| | | | |
|---|---|---|---|
| JP | H10153196 | A | 6/1998 |
| JP | 11-148495 | A | 6/1999 |
| JP | 2001-280288 | A | 10/2001 |
| JP | 2001-329994 | A | 11/2001 |
| JP | 2005-155579 | A | 6/2005 |
| JP | 2006-336642 | A | 12/2006 |
| JP | 2007-218234 | A | 8/2007 |
| JP | 2007-239712 | A | 9/2007 |
| JP | 2007-278268 | A | 10/2007 |
| JP | 2010-275958 | A | 12/2010 |

OTHER PUBLICATIONS

JP2001-280288, English machine translation, translated by ProQuest Sep. 3, 2014.*

JP2001-329994, English machine translation, translated by ProQuest Sep. 3, 2014.*

JP2005-155579, English machine translation, translated by ProQuest Sep. 3, 2014.*

* cited by examiner $\theta 1 \neq \theta 2 \neq \theta 3 \neq \theta 4$ $\theta 1 \neq \theta 2 \neq \theta 3 \neq \theta 4$

FOR EXAMPLE $\theta 1 = 85°$ $\theta 2 = 99°$ $\theta 3 = 89°$ $\theta 4 = 87°$

FIG.20 - BACKGROUND ART-
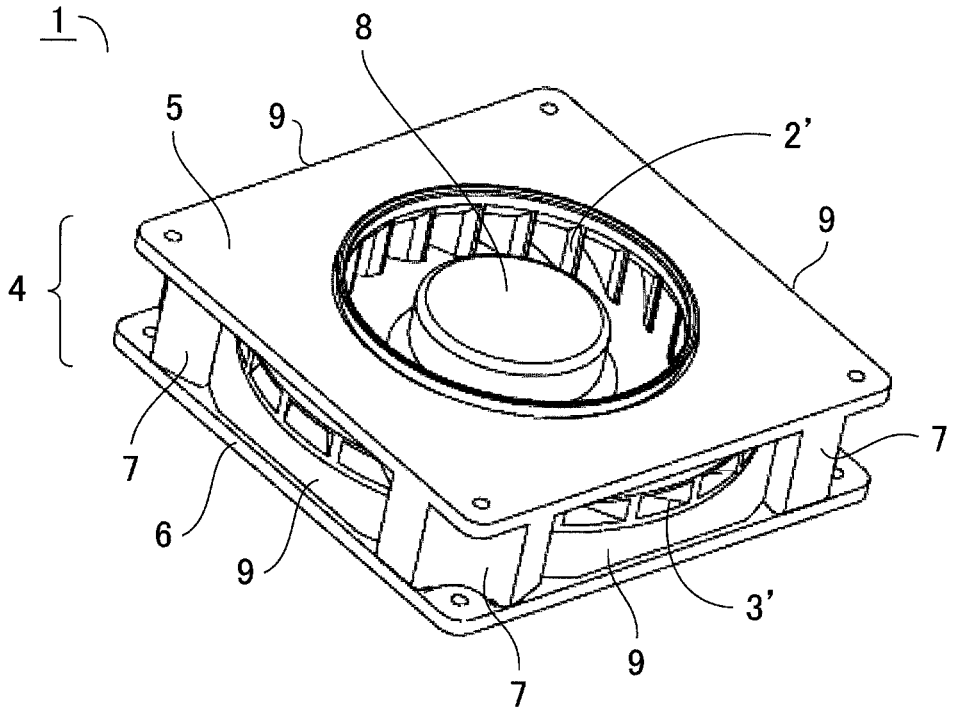

FIG.21 - BACKGROUND ART-
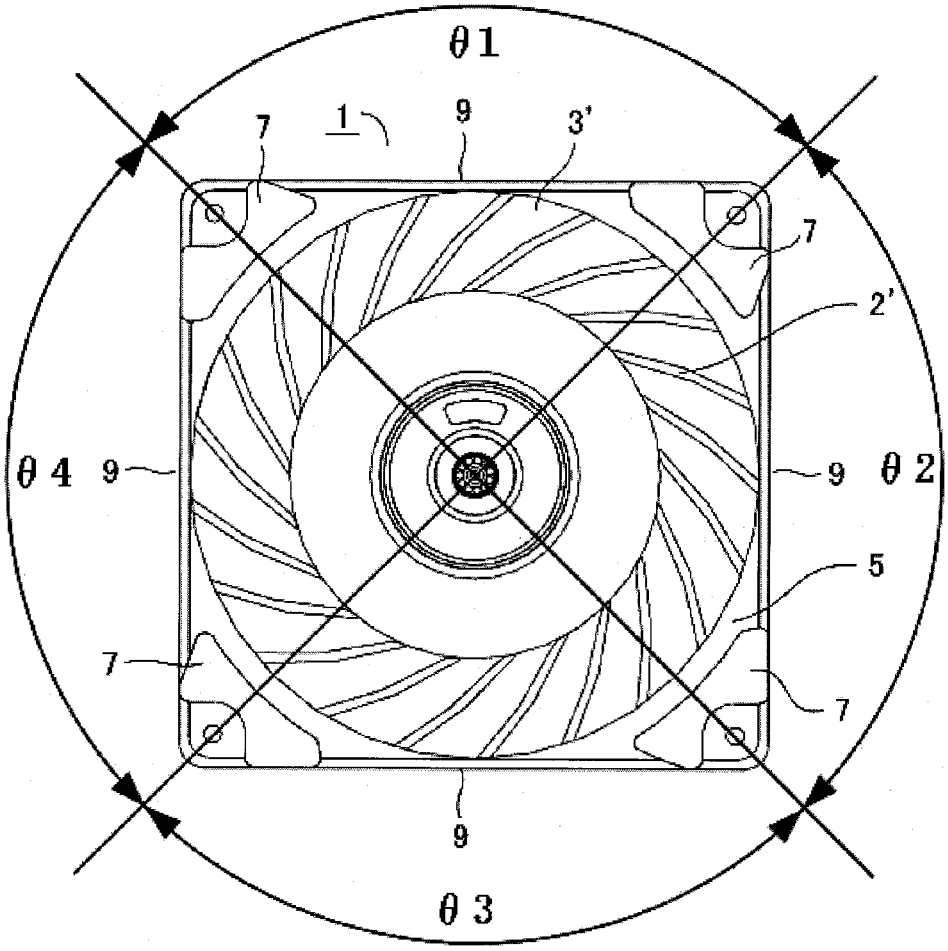
$\theta 1 = \theta 2 = \theta 3 = \theta 4$

IMPELLER AND CENTRIFUGAL FAN USING THE SAME

CROSS-REFERENCE TO RELATED APPLICATION

This application claims priority from Japanese Patent Application No. 2011-055360 filed on Mar. 14, 2011 and Japanese Patent Application No. 2011-074339 filed on Mar. 30, 2011, the entire subject matter of which is incorporated herein by reference.

TECHNICAL FIELD

This discloser relates to an impeller and a centrifugal fan using the impeller and, more specifically, to a centrifugal fan using an impeller accommodated between an upper casing and a lower casing.

BACK GROUND

A centrifugal fan (centrifugal air blower) is a fan, in which air is blown in a centrifugal direction by rotating an impeller having a plurality of blades. As a fan of such a type, a multiblade centrifugal fan has a configuration, in which an impeller having a plurality of blades disposed around a rotation shaft of a motor is accommodated in a casing having an air suction opening and an air outlet opening.

In the multiblade centrifugal fan, air suctioned from the air suction opening is introduced from the center of the impeller into between the blades, and the air is outwardly discharged in a radial direction of the impeller by a centrifugal action caused by rotation of the impeller. The air discharged from the outside of the outer circumference of the impeller passes through the inside of the casing, so that the high-pressure air is ejected from the air outlet opening.

Such a multiblade centrifugal fan is widely used for cooling of home appliances, OA devices, and industrial equipment, and user for ventilation, air conditioning, or in an air blower for a vehicle, and the like. An air blowing performance and noise of the multiblade centrifugal fan are significantly influenced by the blade shape of the impeller and the shape of the casing.

FIG. 20 is a perspective view illustrating the centrifugal fan according to the background art, and FIG. 21 is a plan view illustrating a shape of blades of the centrifugal fan of FIG. 20 with removed a lower plate of a casing.

In a centrifugal fan 1, air is blown by rotation of an impeller 3' disposed in the center thereof. The impeller 3' has twenty-one blades 2' and rotates about a rotation shaft by a fan motor built in the centrifugal fan 1. The rotation direction is counterclockwise in FIG. 21.

The impeller 3' is accommodated in a casing 4. The casing 4 including a upper casing 5 and a lower casing 6, each of which is formed in a plate shape, and pillars 7 are provided four corner portions of the casing 4 so as to hold the upper casing 5 and the lower casing 6 at an equal distance therebetween. An air suction opening 8 is provided in the upper portion of the centrifugal fan 1. Air outlet openings 9 are openings between the pillars 7 of the casing 4. Namely, each of four sides in four directions of the casing 4 becomes the air outlet openings 9 (i.e., open casing type). In addition, the casing 4 may be provided with a single air outlet opening to collect the air ejected from the impeller 3' in a single direction (i.e., scroll casing type).

As shown in FIGS. 20 and 21, each of blades 2' usually has a circular arc shape, and includes a surface (pressure surface) configured to push air by movement thereof and a surface (negative pressure surface) opposite to that surface, each of which is formed in an identical circular arc shape. In addition, as shown in FIG. 21, a thickness of the blades 2' is constant from the inner circumferential side of the impeller 3' toward the outer circumferential side thereof.

With respect to a shape of blades in fans according to the background arts, there are configurations as the following.

JP-A-2005-155579 discloses a multiblade blower fan, in which a cross-sectional shape of at least a part of a negative pressure surface of a front half portion of the blade from an inner-end in the radial direction to an intermediate part in the radial direction in an air flow direction is formed by a multangular line.

JP-A-2007-278268 discloses a multiblade centrifugal fan, in which a front-end of the blades is formed in an acute angle shape having a curvature radius of 0.2 mm or less.

JP-A-2001-329994 discloses a centrifugal blower, in which each of blades of an impeller is configured by forwarding blades having a blade outlet that is curved to be inclined in a rotation direction. The blades are formed in a blade shape, in which a thickness of the blades is gradually thinned from a blade front-end portion toward a blade rear-end portion. An intake angle of the blades is set in consideration of an angle of air introduced along a cone portion, i.e. an inclination angle of the cone portion. In addition, an outlet angle of the blades is set in consideration of a sliding ratio.

JP-A-2001-280288 discloses a multiblade blower, in which an impeller configured by a plurality of blades provided at predetermined pitches in a circumferential direction is disposed in a fan housing having a predetermined shape. A camber line radius of each of the blades on the outer circumferential side of the impeller has a value lager than a camber line radius on the inner circumferential side of the impeller.

JP-A-H11-148495 discloses an impeller of a sirocco fan, in which a plurality of blade plates is arranged on a circle circumference. A contour line of a cross-section of a front-end portion of each blade plate and a contour line of a section of a base-end portion thereof is formed by quadratic curves having specific ranges, and an installation angle of each blade plate is set in a specific range.

In addition, as shown in FIGS. 20 and 21, the pillars 7 have a function of connecting the upper casing 5 with the lower casing 6. The pillars 7 are configured by three or more pillars (four pillars in the drawings) arranged around the impeller 3. Intervals between two adjacent pillars are set at equal intervals. Namely, a plurality of angles from θ1 to θ4 formed between two of a plurality of straight lines connecting between a rotation axis of the impeller 3 and each of pillars 7 are all equal each other.

With respect to a shape of a casing (housing) in fans according to the background arts, there are configurations as the following.

JP-A-2006-336642 discloses a centrifugal fan, in which a barricade extending outward is formed on one side of an intake port to suppress suctions of outside foreign matters into the intake port.

JP-A-2010-275958 discloses a centrifugal fan, in which a circuit board that is protrude radially outward from a housing is provided, and at least one of electronic parts is arranged outer than an inner circumferential surface of a sidewall portion of the housing JP-A-2007-239712 discloses a centrifugal fan, in which a sidewall portion of housing is formed by a body sidewall portion of a housing body and a cover sidewall portion of a housing cover.

JP-A-2007-218234 discloses a centrifugal fan, in which an exhaust port is formed on a side surface of housing, and a flow passage directed toward the exhaust port is formed between a sidewall portion and the outer circumference of an impeller portion. An intake port is formed in a bottom portion of the housing.

SUMMARY

As miniaturization, thin shaping, high density mounting, and energy saving of devices are progressed, a higher static pressure and a higher efficiency are required with respect to fan motors equipped in the devices.

The centrifugal fan shown in FIGS. 20 and 21 also requires improvements with respect to an air flow rate, static pressure, and noise level.

However, the shape, in which the pressure surface of the blades is formed based on a single circular arc as shown in FIG. 21, causes a problem that the shape is not suitable for air flow rate. Namely, each of the pressure surface and the negative pressure surface of the blades 2' in FIG. 21 corresponds to the single circular arc shape having a predetermined diameter. Due to such a blade shape, the air flow rate or the static pressure can be reduced, so that a degradation of the noise level may be also caused.

In particular, the centrifugal fan shown in FIGS. 20 and 21 has problems that both of a discrete frequency noise (narrow-band noise) and a broadband noise are generated at higher levels, and thus a noise level when equipped in a device is also higher.

As used herein, the term "discrete frequency noise" means a noise based on a blade passing frequency noise, and is referred also to as a "NZ noise." The discrete frequency noise is a noise having a characteristic peaks at a specific frequency of the narrow frequency band. The frequency is expressed as the following equation: fnz=[rotation frequency: n]×[the number of blades: z]. The discrete frequency noise causes a significant problem in actual audition, because secondary and tertiary components, in addition to a primary component, will be generated. Namely, when the centrifugal fan is equipped in a device, there is a risk of generating a noise as obvious sound. The dominant cause of the broadband noise is a turbulent flow. The broadband noise is also required to reduce because the broadband noise determines a total noise level.

This discloser provides an impeller having a blade shape suitable for an air flow and a centrifugal fan using the impeller and provides a centrifugal fan in which a noise level lowering can be achieved without degrading an air flow rate characteristic.

According to one aspect of the invention, an impeller comprises: a main plate; a shroud; and a plurality of blades provided between the main plate and the shroud and arranged circumferentially, wherein the impeller is configured to rotated about a rotation axis, wherein the plurality of blades include a pressure surface and a negative pressure surface, and the pressure surface has a shape, in which at least three types of circular arcs are connected, as viewed from a rotation axial direction.

In the above-described impeller, the circular arcs may have three types, and each of the circular arcs may have a center at a different position coordinate and has a different diameter, from each other.

In the above-described impeller, the pressure surface may has a shape, in which three circular arcs are connected, when viewed in a rotation axial direction, radiuses of two circular arcs provided at both end of the pressure surface may be substantially equal to each other, and a radius of one circular arc provided at center of the pressure surface may be smaller than the radiuses of two circular arcs provided at both end of the pressure surface.

In the above-described impeller, a difference between the radiuses of the two circular arcs provided at both end of the pressure surface may is less than 3%, and the radius of the one circular arc provided a center part may be from 35 to 40% of the radiuses of the two circular arcs.

In the above-described impeller, the pressure surface has a shape formed by a combination of a plurality of higher-order functions passing through three predetermined points.

In the above-described impeller, the three predetermined points may be determined based on an inner diameter of the impeller, an outer diameter of the impeller, an intake angle, an outlet angle, and a deflection angle.

In the above-described impeller, each of the plurality of blades may have a thickness, which is thinned as the distance from the rotation axis.

In the above-described impeller, each of the plurality of blades may have a thickness, which is maintained in a predetermined range at a predetermined distance from the rotation axis.

According to another aspect of the invention, a centrifugal fan comprises: an upper casing; a lower casing; the above-described impeller accommodated between the upper casing and the lower casing; and three or more pillars arranged around the impeller to connect the upper casing with the lower casing, wherein, an interval between one adjacent pillars of the three or more pillars is different from an interval between the other adjacent pillars of the three or more pillars.

According to another aspect of the invention, a centrifugal fan comprises: an upper casing; a lower casing; an impeller accommodated between the upper casing and the lower casing; and three or more pillars arranged around the impeller to connect the upper casing with the lower casing, wherein an interval between one adjacent pillars of the three or more pillars is different from an interval between the other adjacent pillars of the three or more pillars.

In the above-described centrifugal fan, the impeller may comprises a plurality of blades each including a pressure surface and a negative pressure surface, and the pressure surface has a shape, in which at least three types of circular arcs are connected, as viewed from a rotation axial direction.

In the above-described impeller, intervals between adjacent pillars may be different from each other.

In the above-described impeller, the upper casing and the lower casing may have a contour of a quadrilateral shape when viewed in a plan view, the number of pillars is four, and the pillars are provided in corner portions of the upper casing and corner portions of the lower casing.

In the above-described impeller, a plurality of angles formed by a plurality of straight lines connecting between the rotation axis of the impeller and each of the three or more pillars are different from each other.

In the above-described impeller, the pillars may have a streamline shape.

In the above-described impeller, spaces surrounded by the upper casing, the lower casing and the pillars may function as air outlet openings.

According to this discloser, an impeller having a blade shape suitable for an air flow and a centrifugal fan having the impeller may be provided, and a centrifugal fan, in which a noise level lowering can be achieved without degrading an air flow rate characteristic, also may be provided.

BRIEF DESCRIPTION OF THE DRAWINGS

The foregoing and additional features and characteristics of this disclosure will become more apparent from the following detailed descriptions considered with the reference to the accompanying drawings, wherein:

FIG. 20 is a perspective view illustrating the centrifugal fan according to the background art; and FIG. 21 is a view illustrating a shape of blades of the centrifugal fan of FIG. 20 as viewed from a lower casing.

DETAILED DESCRIPTION

Hereinafter, illustrative embodiments of this discloser will be described with reference to the accompanying drawings.

First Illustrative Embodiment

Figure 1:
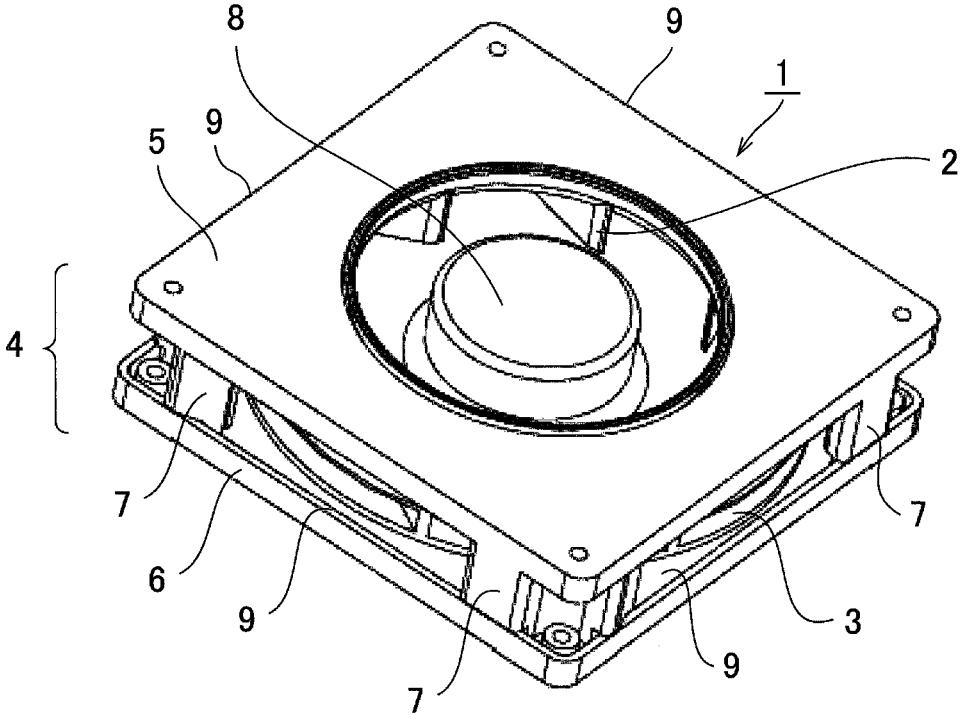
FIG. 1 is a perspective view illustrating a centrifugal fan according to an illustrative embodiment of this discloser.
Figure 2:
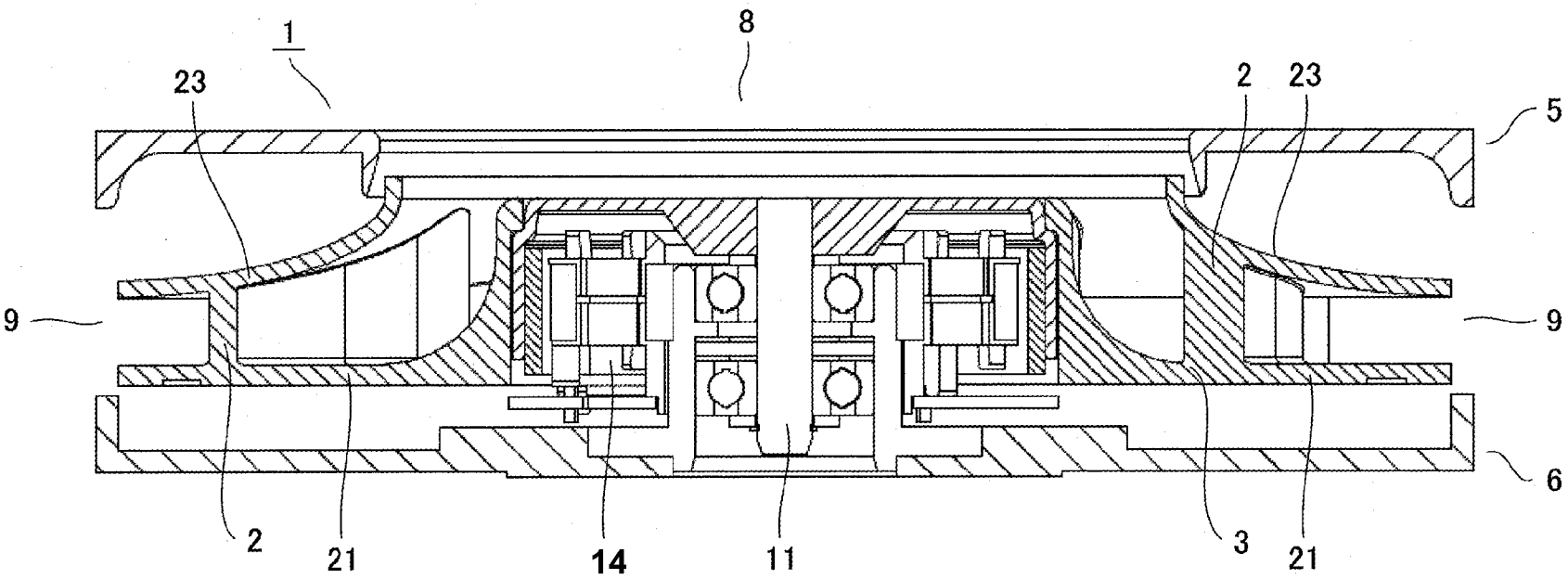
FIG. 2 is a central longitudinal sectional view of the centrifugal fan of FIG. 1.

FIG. 1 is a perspective view illustrating a centrifugal fan according to an illustrative embodiment of this discloser, and FIG. 2 is a central longitudinal sectional view of the centrifugal fan of FIG. 1. In addition, FIG. 3 is a view illustrating a shape of blades of the centrifugal fan of FIG. 1, as viewed from an upper casing 5.

Figure 3:
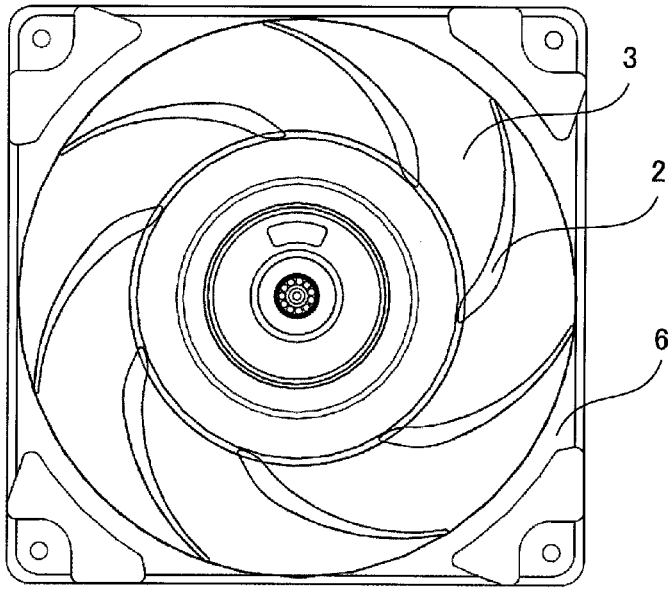
FIG. 3 is a view illustrating a shape of blades of the centrifugal fan of FIG. 1, as viewed from an upper casing.

Referring to FIGS. 1 to 3, a centrifugal fan 1 blows air by rotations of an impeller 3 disposed in the center thereof. The impeller 3 has seven blades 2 arranged at equal intervals to each other and is rotated about a rotation shaft 11 by a fan motor 14 built in the centrifugal fan 1. The rotation direction is clockwise in FIG. 3.

The impeller 3 is accommodated in a casing 4. The casing 4 including a upper casing 5 and a lower casing 6, each of which is formed in a plate shape, and pillars 7 are provided at four corner portions of the casing 4 so as to hold the upper casing 5 and the lower casing 6 at an equal distance therebetween. An air suction opening 8 is provided in the upper portion of the centrifugal fan 1. Air outlet openings 9 are openings between the pillars 7 of the casing 4. Namely, each of four sides in four directions of the casing 4 becomes the air outlet openings 9 (i.e., open casing type). In addition, the casing 4 may be provided with a single air outlet opening to collect the air outlet from the impeller 3 in a single direction (i.e., scroll casing type).

As shown in FIG. 2, the impeller 3 has a disk-shaped main plate 21, an annular shroud 23, and a plurality of blades 2 provided between the main plate 21 and the shroud 23 and arranged circumferentially. The impeller 3 can be rotated about the rotation shaft 11.

Figure 4:
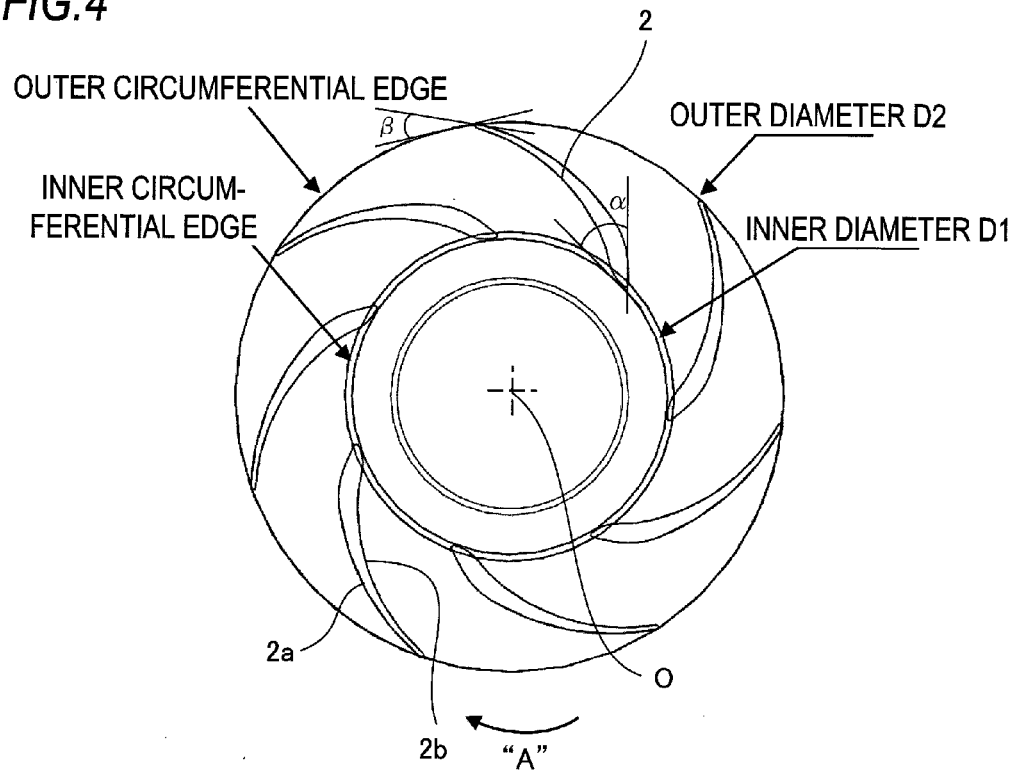
FIG. 4 is a view illustrating a structure of an impeller of FIG. 3.

FIG. 4 is a view illustrating a structure of an impeller of FIG. 3.

As shown in FIG. 4, each of the plurality of blades 2 is rotated about a center O in an arrow "A" direction (i.e., clockwise direction). Each of blades 2 has a pressure surface 2*a* facing forward in the rotation direction, and a negative pressure surface 2*b* facing in the opposite direction. The pressure surface 2*a* is a surface configured to push air during rotating.

One end of each of blades 2 is formed on an inner diameter portion (inner circumferential edge) having a diameter D1 from the center O, and the other end of each of blades 2 is located on an outer diameter portion (outer circumferential edge) having a diameter D2 from the center O.

FIG. 4 illustrates a shape of blades 2 as viewed from an axial direction along which is extended a rotation axis of the impeller 3. In FIG. 4, the pressure surface 2*a*, the negative pressure surface 2*b*, the inner circumferential edge, and the outer circumferential edge are thus all shown in curved lines. An intake angle $\alpha$ of each of blades 2 is 45 degrees, and an outlet angle $\beta$ thereof is 30 degrees in this illustrative embodiment.

Additionally, the term "intake angle $\alpha$" means an angle that is an intersection angle between a tangent line to the inner circumferential edge and a tangent line to the curved line corresponding to the pressure surface 2*a* at a contacting point between a curved line corresponding to the pressure surface 2*a* and the inner circumferential edge shown in FIG. 4, and the angle has a range of 90 degrees or less. The term "outlet angle $\beta$" means an angle that is an intersection angles between a tangent line to the outer circumferential edge and a tangent line to the curved line corresponding to the pressure surface 2*a* at a contacting point between the curved line corresponding to the pressure surface 2*a* and the outer circumferential edge shown in FIG. 4, and the angle has a range of 90 degrees or less.

The curved line corresponding to the pressure surface 2*a* shown in FIG. 4 may be provided as a shape, in which at least three types of circular arcs are connected, or a shape, in which a plurality of higher-order functions passing through three points are combined.

FIGS. 5 to 9 are views illustrating a shape of blades of the impeller 3.

Figure 5:
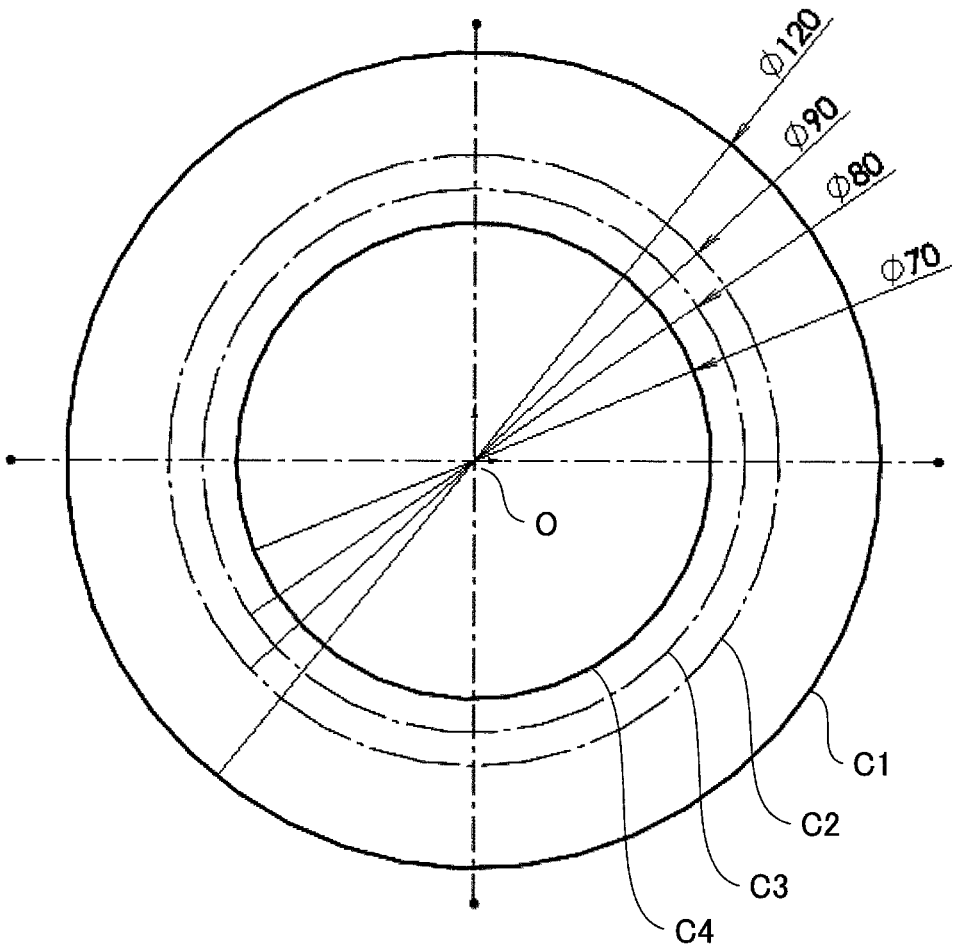
FIG. 5 is a first view illustrating a shape of blades of the impeller.

The cross-sectional shape of the pressure surface 2*a* described above can be determined in the following manner. As shown in FIG. 5, the outer circumferential edge is set in a circle having a diameter of 120 mm, the inner circumferential edge is set in a circle having a diameter of 70 mm, and such two circles are respectively indicated as concentric circles C1 and C4. However, sizes of the inner circumferential edge and the outer circumferential edge are determined by design objective or a size of the motor, and thus the pressure surface is not limited to the sizes described above.

Then, a circle C2 that has a size equal to three-fourths of the size of the circle C1 corresponding to the outer circumferential edge (i.e., a diameter of 90 mm) is set, as a concentric circle with respect to the circles corresponding to the inner circumferential edge and the outer circumferential edge. Also, a circle C3 is set between the circle C4 corresponding to the inner circumferential edge and the circle C2, as a concentric circle with respect to the circles corresponding to the inner circumferential edge and the outer circumferential edge.

Figure 6:
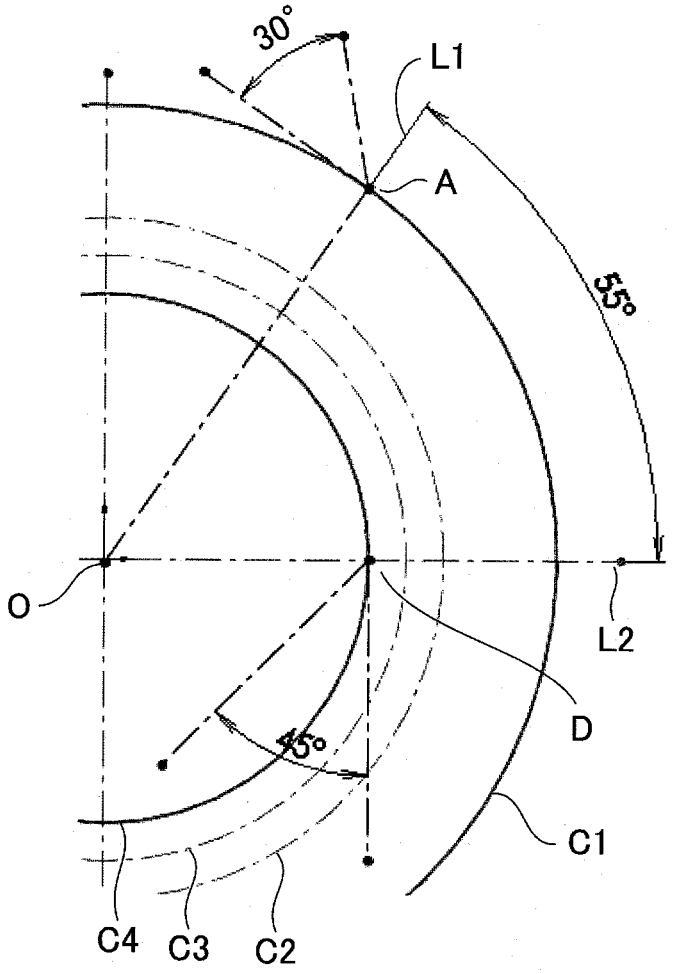
FIG. 6 is a second view illustrating the shape of blades of the impeller.

As shown in FIG. 6, the intake angle α (45 degrees), the outlet angle β (30 degrees), and a deflection angle (55 degrees) are set. The intake angle has an affect on a noise level, and the intake angle is set to 45 degrees to reduce a NZ sound. The outlet angle has an affect on a static pressure, and the outlet angle is varied according to design objective. In addition, the deflection angle has an affect on a static pressure, and the deflection angle is varied according to design objective. A location where the intake angle α is measured is indicated as point D, and a location where the outlet angle β is measured is indicated as point A. A straight line passing through the points A and O is referred to as a line L1, and a straight line passing through the points D and O is referred to as a line L2. The deflection angle is an angle determined by two line L1 and L2 passing through the center O of the circles. The point A is an intersecting point of the line L1, which passes through the center O and is one of the lines determining the deflection angle, and the outer circumferential circle C1. The point D is an intersecting point of the line L2, which passes through the center O and is the other of the lines determining the deflection angle, and the inner circumferential circle C4.

Figure 7:
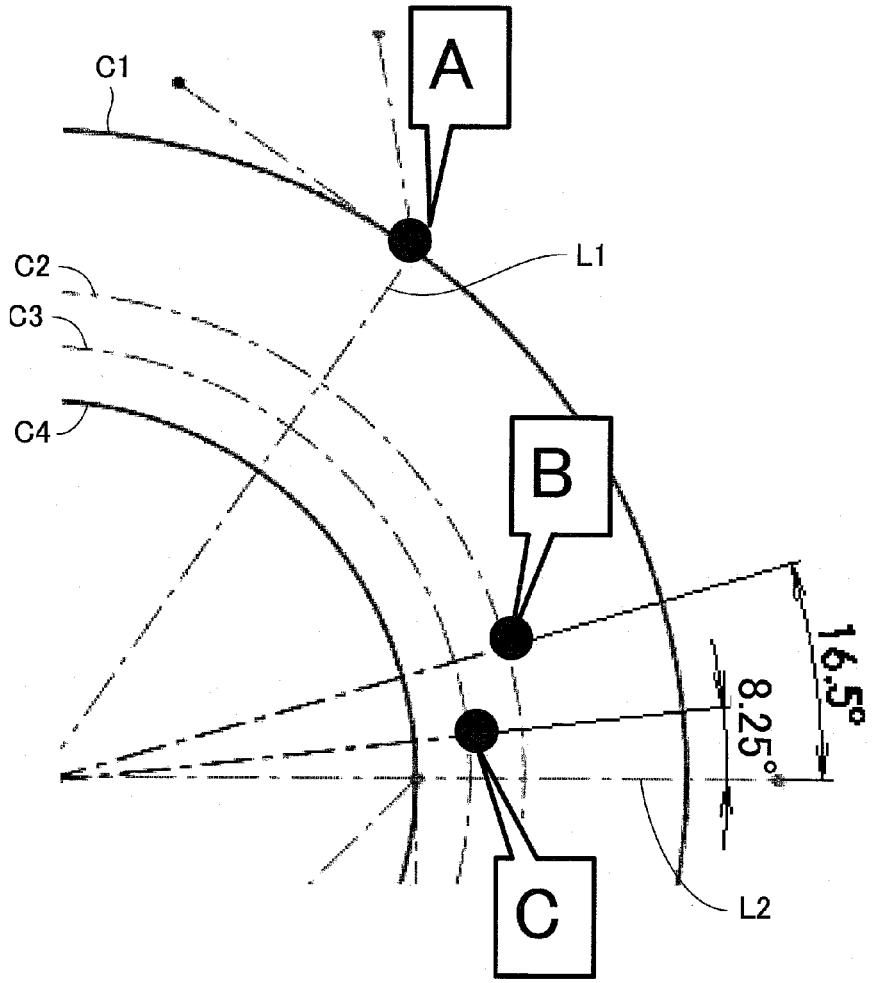
FIG. 7 is a third view illustrating the shape of blades of the impeller.

As shown in FIG. 7, a straight line is set to pass through the center O of the circles between the lines L1 and L2 determining the deflection angle and to form a angle (16.5 degrees), which corresponds to three-tenths of the deflection angle with respect to the line L2, and an intersecting point of the straight line and the circle C2 is indicated as point B. Also, a straight line is set to pass through the center O of the circles between the lines L1 and L2, which determines the deflection angle and to form a angle (8.25 degrees), which corresponds to three-twentieths of the deflection angle with respect to the line L2, and an intersecting point of the straight line and the circle C3 is indicated as point C.

Figure 8:
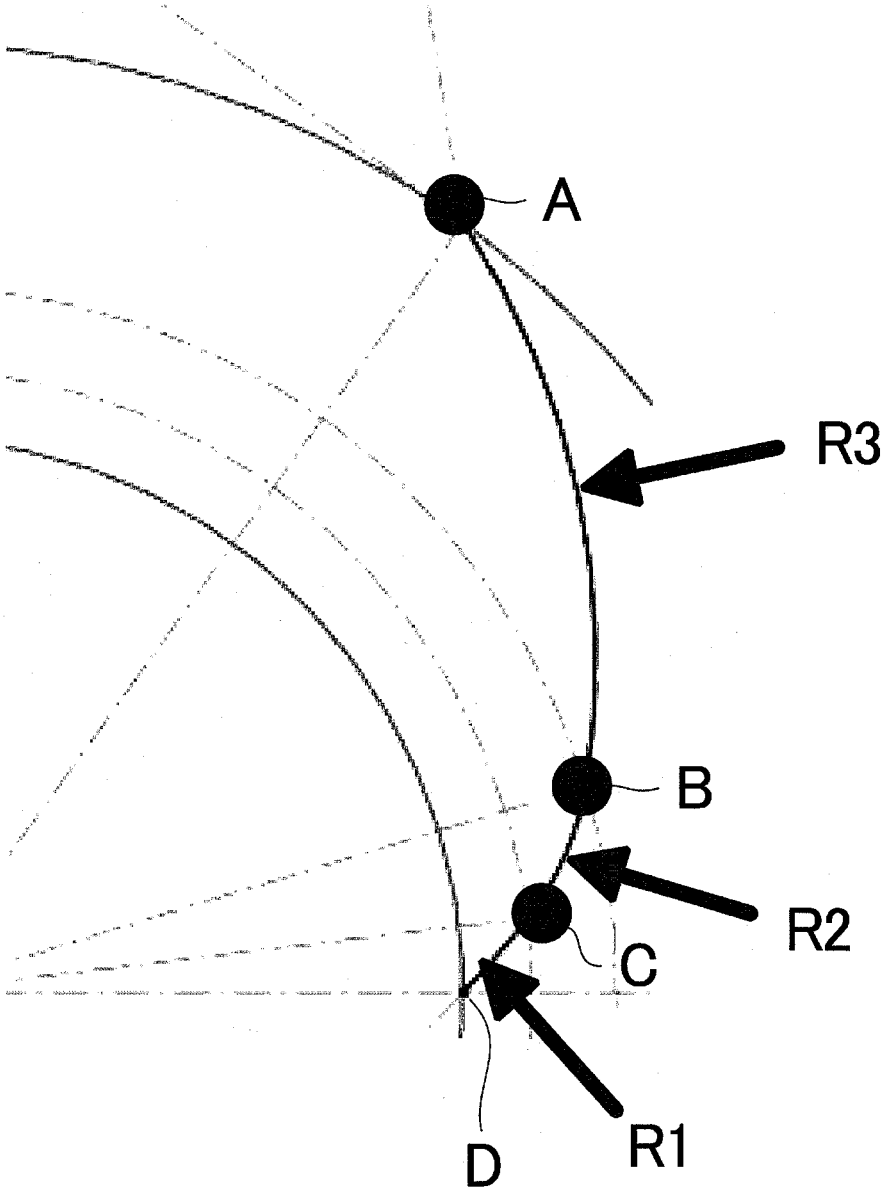
FIG. 8 is a fourth view illustrating the shape of blades of the impeller.

As shown in FIG. 8, three circular arcs R3, R2, and R1 are set to connect the points A, B, C and D. A set of circular arcs R3 and R2 and a set of circular arcs R2 and R1 are respectively set in a tangential relation. As used herein, the term "tangential relation" means a relation in which tangent lines of two circular arcs at a connecting point of two circular arcs are overlapped each other.

Figure 9:
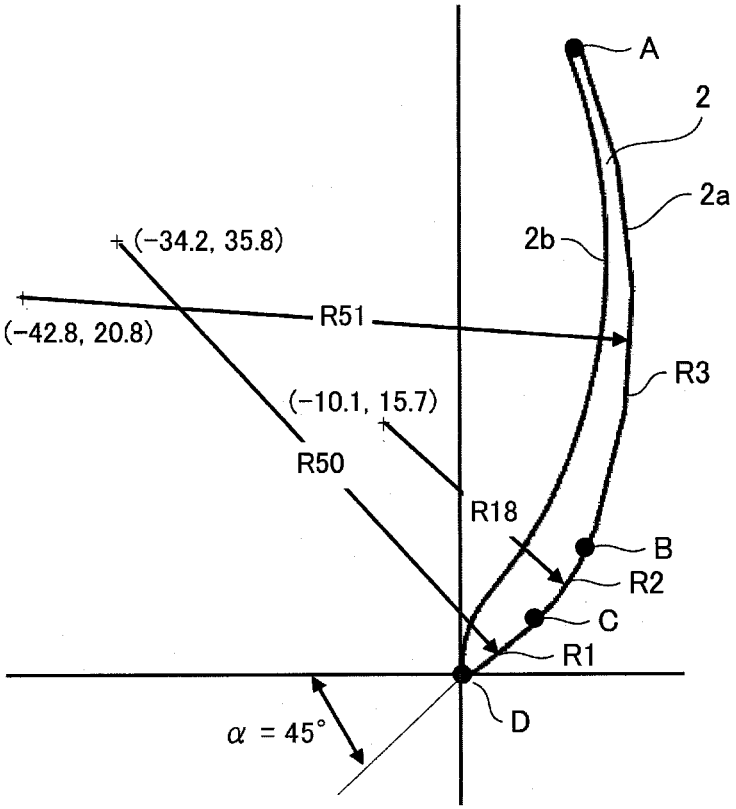
FIG. 9 is a fifth view illustrating the shape of blades of the impeller.

FIG. 9 is a view illustrating a shape of blades of the impeller 3 and illustrating characteristics of the circular arcs R3 to R1.

Assuming a coordinates system, in which the point D where the intake angle α is measured is set to an origin, a right side in a X direction (a horizontal direction in the drawing) is set to plus, and an upper side in a Y direction (a vertical direction in the drawing) is set to plus, the circular arcs R1, R2 and R3 are formed as the following:

- R1 is formed in a circular arc in which a reference point (center coordinates) is (X, Y)=(−34.2 mm, 35.8 mm), a radius is 50 mm, and ends thereof are located at the points C and D;
- R2 is formed in a circular arc in which a reference point (center coordinates) is (X, Y)=(−10.1 mm, 15.7 mm), a radius is 18 mm, and ends thereof are located at the points B and C; and
- R3 is formed in a circular arc in which a reference point (center coordinates) is (X, Y)=(−42.8 mm, 20.8 mm), a radius is 51 mm, and ends thereof are located at the points A and B.

For the radiuses of the circular arcs, the radius of the circular arc R3 and the radius of the circular arc R1 are substantially equal to each other. Preferably, a difference between the radiuses is less than 3%. The radius of the circular arc R2 located between the circular arcs R3 and R1 is smaller than the radiuses of the circular arcs R3 and R1, preferably is from 35 to 40% of the radiuses of the circular arcs R3 and R1. Meanwhile, the reference points of three circular arcs are examples and are not limited to them.

With respect to the negative pressure surface, a contour of the blades having a blade shape may be achieved by thinning a thickness of the blades as forwarding through the point D toward the point A and forming a curve to be formed in a shape following a shape of the pressure surface. For example, by determining a curvature radius of the negative pressure surface at the point A and forming a curve having curvature radiuses gradually reduced toward the point D, the shape as shown in FIG. 9 may be achieved.

The centrifugal fan according to the illustrative embodiment configured as described above has the following features. Namely, the shape of the pressure surface of the blades is configured by three circular arcs (R1, R2, and R3). In addition, the shape of the pressure surface of the blades may be expressed by a combination of a plurality of higher-order functions described below (the higher-order function means a function of higher order than a quadratic function).

$$y=0.108x^3-0.375x^2+0.767x$$

$$y=-2.56x^3+30.0x^2-119.3x+174.9$$

(A front end of the blades is the origin. A predetermined numerical range of the respective equations corresponds to the shape of the pressure surface of the blades. The equations are examples and not limited to them.)

By determining the shape of the blades as described above, the centrifugal fan having a good efficiency according to an air flow rate is to be manufactured, thereby achieving a higher flow rate/higher static pressure/lower noise level.

Also, the centrifugal fan according to the illustrative embodiment may be applied to any centrifugal fans, including a turbo type, a multi-blade type, a radial type and the like. The centrifugal fan may be applied to apparatuses (such as, home appliances, PCs, OA devices, on-vehicle devices) that is mainly requires a suction cooling.

Figure 10:
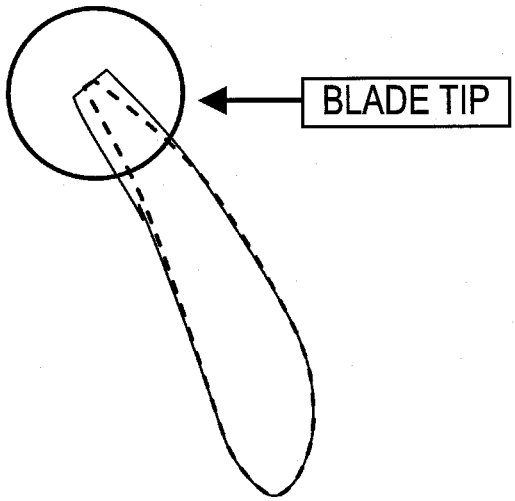
FIG. 10 is a view illustrating an example of the shape of blades of the impeller.

FIG. 10 is a view illustrating an example of a shape of blades of the impeller 3 according to the illustrative embodiment.

The shape of the blades may be determined by a combination of above-described circular arcs or equations. In addition, as shown in FIG. 10, a thickness of a blade tip can be suitably adjusted. For example, as shown in FIG. 10, a stiffness of the blades can be increased by forming a thickness of a front end portion of the blades to not be thinner than a predetermined thickness (i.e., by thickening a thickness of the blades in outer edge portions with respect to those in FIG. 9). Namely, a thickness of portions of the blades at a predetermined distance from the rotation axis is maintained in a predetermined range (i.e., not decreased below the predetermined thickness), so that the stiffness of the blades is increased.

Figure 11:
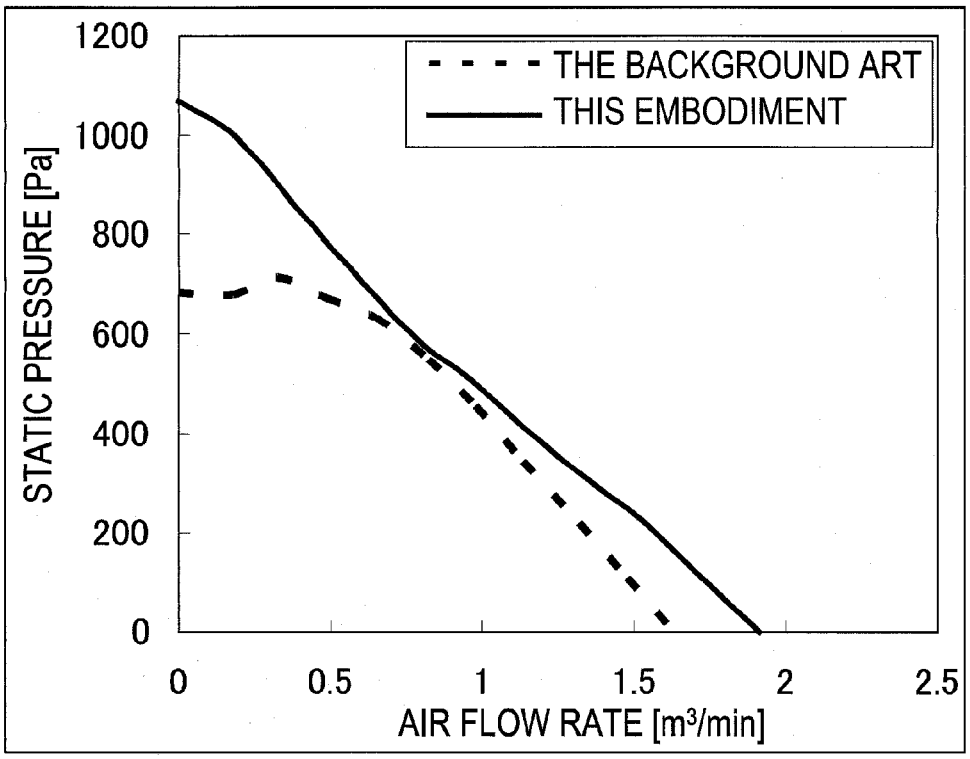
FIG. 11 is a view illustrating characteristics between a static pressure and an air flow rate in the centrifugal type fan according to FIGS. 1 to 9 and a centrifugal fan according to the background art.

FIG. 11 is a view illustrating characteristics between a static pressure and an air flow rate in the centrifugal type fan according to FIGS. 1 to 9 and a centrifugal fan according to the background art.

In the drawing, a horizontal axis of a graph indicates an air flow rate, and a vertical axis indicates a static pressure. In the graph, a dotted line indicates a characteristic of the centrifugal fan according to the background art, and a solid line indicates a characteristic of the centrifugal type fan according to FIGS. 1 to 9.

As shown in FIG. 11, the centrifugal fan according to the illustrative embodiment may achieve a higher static pressure at any air flow rates, when compared to the relation art.

Figure 12:
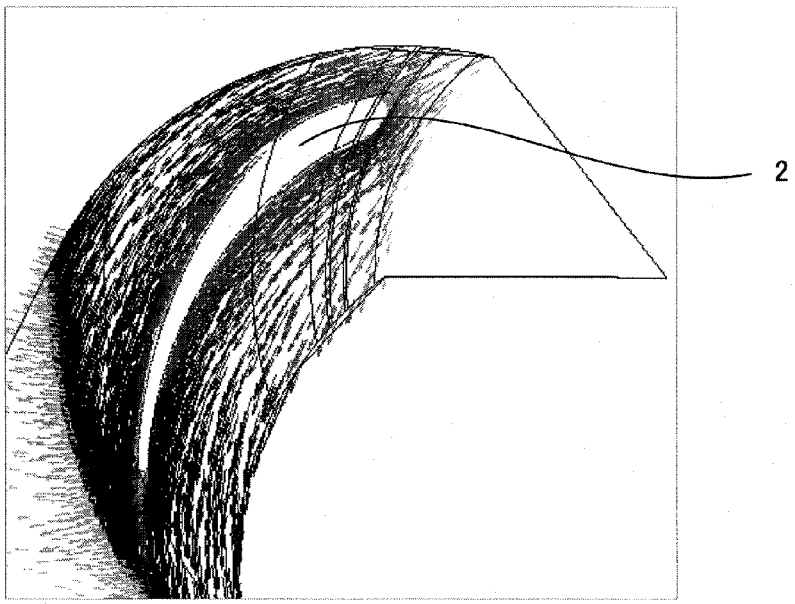
FIG. 12 is a view illustrating a simulation result of the air flow rate in the centrifugal fan according to FIGS. 1 to 9.

FIG. 12 is a view illustrating a simulation result of an air flow rate in the centrifugal fan according to FIGS. 1 to 9, and FIG. 13 is a view illustrating a simulation result of an air flow rate in the centrifugal fan according to the background art.

Figure 13:
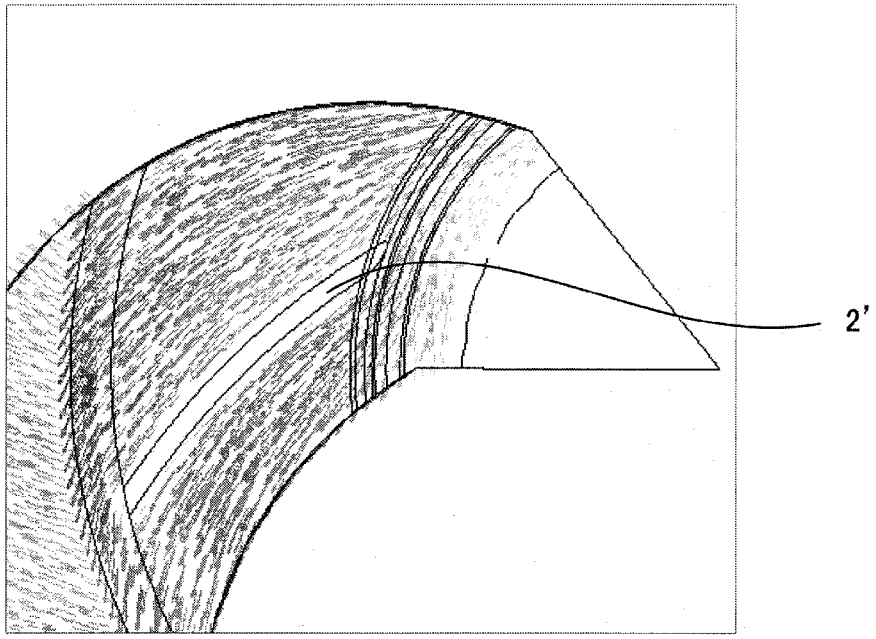
FIG. 13 is a view illustrating a simulation result of the air flow rate in the centrifugal fan according to the background art shown in FIG. 20.

In the drawings, flows of air around the blades 2 and 2' are indicated as arrow lines, and color densities of the arrow lines corresponds velocities of air. The arrow line having a darker color means a flow having a faster velocity than those of the arrow line having a lighter color. As shown in FIGS. 12 and 13, the shape of the blades of the illustrative embodiment may generally increase flow velocities, so that a higher flow rate is achieved. Thus, according to the illustrative embodiment, the shape of the blades from a base portion of the blades to the front end portion of the blades may accelerate the air.

Also, the centrifugal fan according to FIGS. 1 to 9 may suppress a generation of a discrete frequency noise. Specifically, there is a noise reduction effect of 1.5 dB (A), when compared to the centrifugal fan of the background art. Furthermore, the primary peak level of NZ noise may be reduced, and a generation of the secondary peak of NZ noise may be also significantly suppressed. In a range of frequency from 1 kHz to 4 kHz which is a most important subject of actual audition (i.e., being heard as obvious sounds), a significant peak protruded from a broad band noise may be eliminated, thereby providing the centrifugal fan having a higher industrial value.

Meanwhile, the shape of the pressure surface of the centrifugal fan is not limited to three circular arcs, but may be shapes provided by a combination of more than three circular arcs. In addition, the numerical values mentioned in the illustrative embodiment are illustrative ideal numerical values, and thus, even if an error of approximately ±10% is included, the centrifugal fan manufactured will provide the effect of this discloser. For example, the radius of the circular arc R1 shown in FIG. 9 may be in a range from 45 mm to 55 mm including an error of approximately ±10% with respect to 50 mm. Similarly, the numerical values, such as the coordinate values, the angles, and the diameters as described above, may include an error of approximately ±10%.

As described above, the shape of the blades of the centrifugal fan is configured by a combination of three or more circular arcs or higher-order function curves. Therefore, the blade shape having a good efficiency according to an air flow direction may be manufactured, thereby achieving a higher flow rate, higher static pressure, and lower noise level. In addition, by configuring the shape of the blades by three circular arcs or smooth curves (e.g., higher-order functions, such as quadratic functions or cubic functions), the thickness of the blade tip may be suitably adjusted, thereby increasing the stiffness of the blades. Also, a pneumatic noise may be reduced, thereby achieving a lower noise level.

Second Illustrative Embodiment

Now, the second illustrative embodiment of this discloser will be described. However, the description overlapped with those of the above illustrative embodiment will be omitted.

Figure 14:
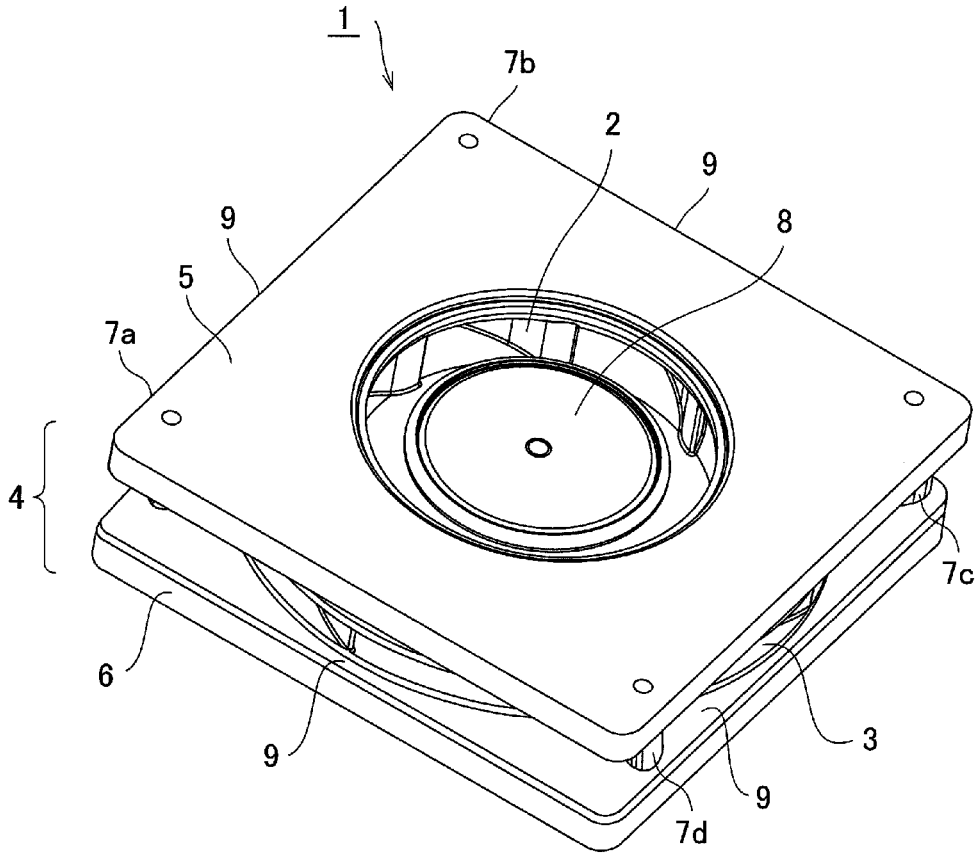
FIG. 14 is a perspective view illustrating a centrifugal fan according to another illustrative embodiment of this discloser.
Figure 15:
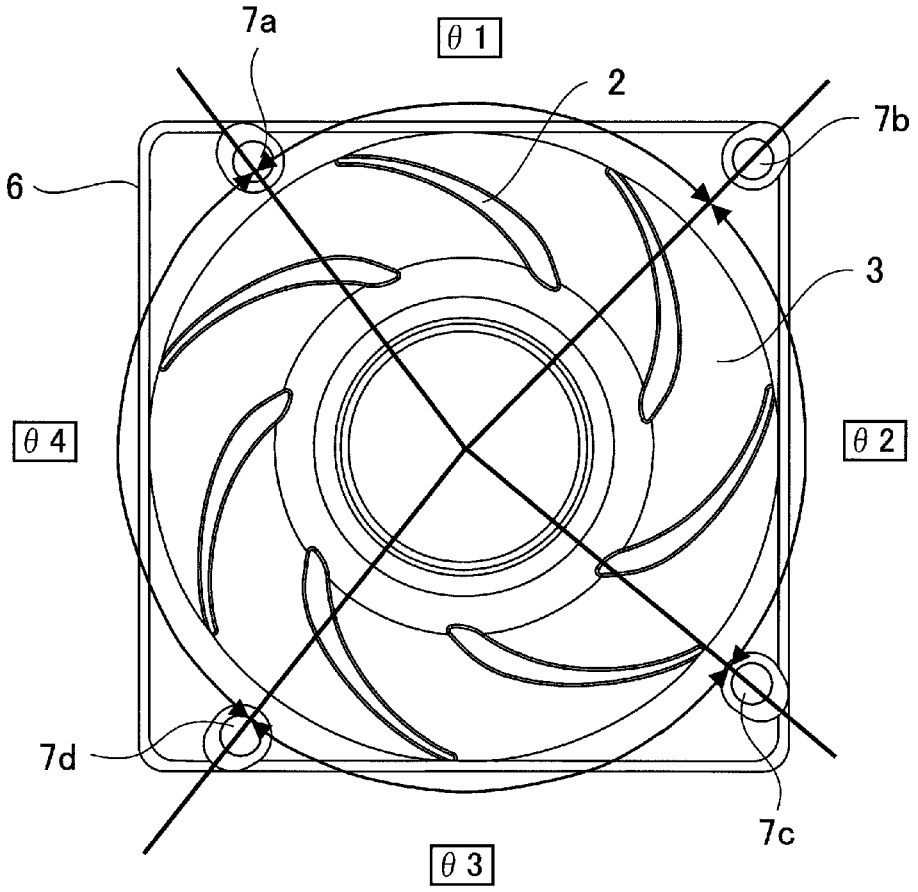
FIG. 15 is a view illustrating a shape of blades and locations of pillars in the centrifugal fan of FIG. 14, as viewed from an upper casing.

FIG. 14 is a perspective view illustrating a centrifugal fan according to another illustrative embodiment of this discloser, and FIG. 15 is a view illustrating a shape of blades and locations of pillars in the centrifugal fan of FIG. 14, as viewed from an upper casing 5.

According to the illustrative embodiment, as shown in FIG. 15, a plurality of angles θ1 to θ4 formed by a plurality of straight lines connecting between the rotation axis (rotation center) of the impeller 3 and each of pillars 7*a* to 7*d* are different from each other. Namely, an interval between adjacent pillars of the pillars 7*a* to 7*d* is different from intervals between other adjacent pillars. The term "adjacent pillars" means any one set of sets of the pillars 7*a* and 7*b*, the pillars 7*b* and 7*c*, the pillars 7*c* and 7*d*, and the pillars 7*d* and 7*a*. Namely, the term "adjacent pillars" indicates one couple of adjacent pillars of a plurality of pillar sets.

Each of the pillars 7*a* to 7*d* preferably has a streamline shape to minimize a resistance of air outwardly blown from the impeller 3, as shown in FIG. 15, as viewed in a plan view.

The structure of the impeller 3 of FIG. 15 is identical to those of FIGS. 1 to 4 of the first illustrative embodiment, and thus the description thereof will be omitted.

Figure 16:
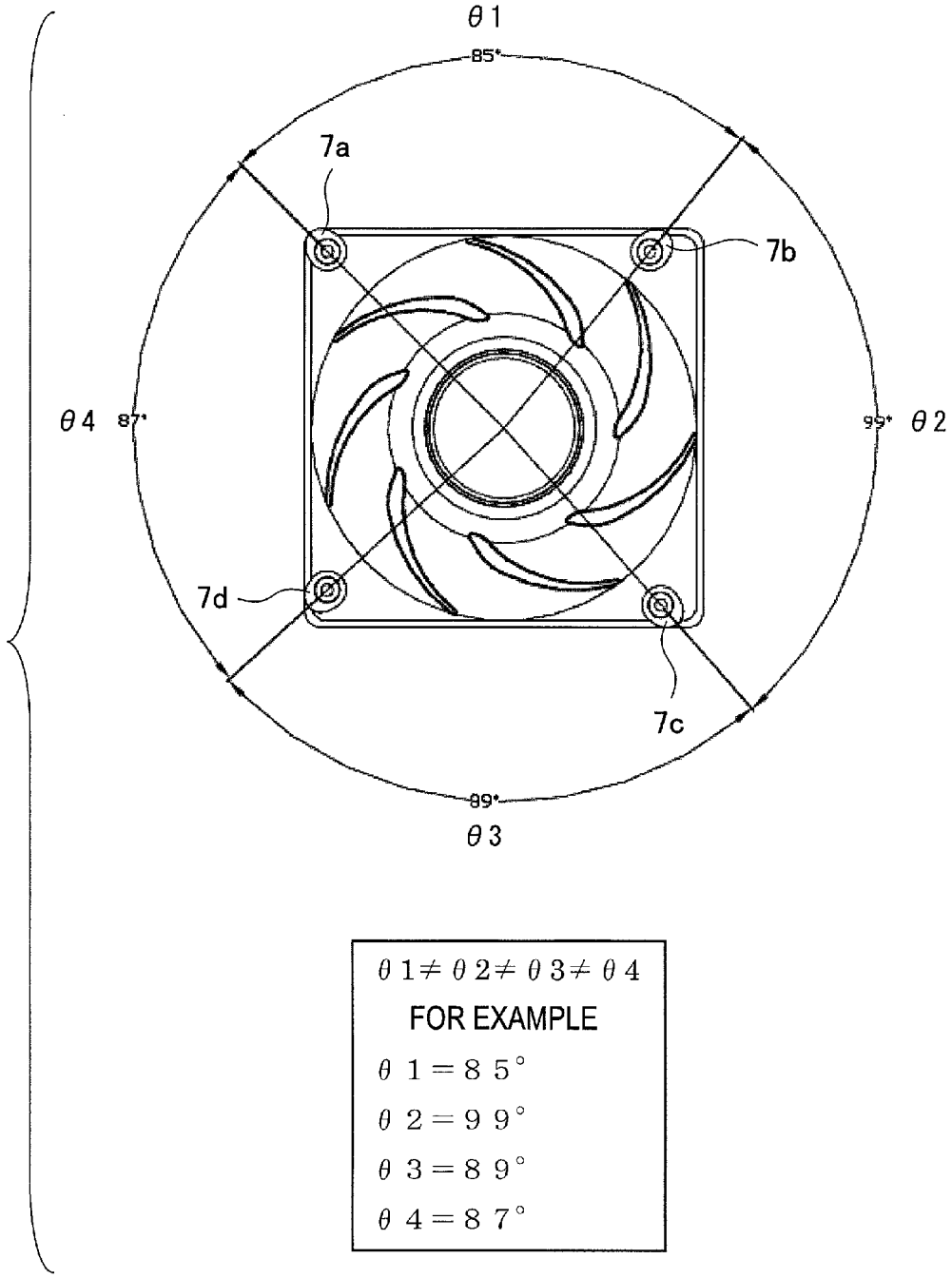
FIG. 16 is a view illustrating a shape of blades and locations of pillars in the centrifugal fan of the another illustrative embodiment, as viewed from an upper casing.

FIG. 16 is a view illustrating a shape of blades and locations of pillars in the centrifugal fan according to an example of the illustrative embodiment, as viewed from an upper casing 5.

Also in this case, a plurality of angles θ1 to θ4 formed by a plurality of straight lines connecting between the rotation axis (rotation center) of the impeller and respective pillars 7*a* to 7*d* are different from each other. In addition, intervals between adjacent pillars of the pillars 7*a* to 7*d* are different from each other (i.e., an interval between one adjacent pillars of the pillars 7*a* to 7*d* is different from intervals between the other adjacent pillars).

In this case, the angles θ1 to θ4 are set as follows: θ1=85 degrees, θ2=99 degrees, θ3=89 degrees, and θ4=87 degrees.

The centrifugal fan may be adapted to any centrifugal fans, including a turbo type, a multi-blade type, a radial type and the like. The centrifugal fan may be applied to apparatuses (such as, home appliances, PCs, OA devices, on-vehicle devices) that is mainly requires a suction cooling.

Figure 17:
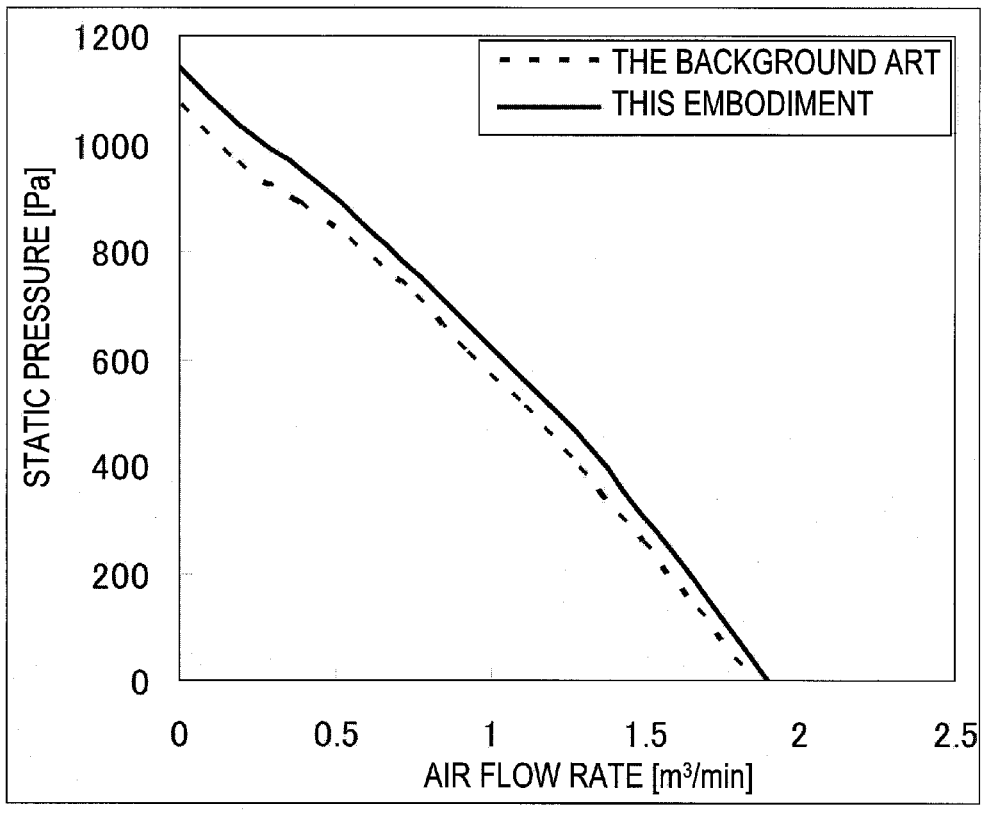
FIG. 17 is a view illustrating characteristics between a static pressure and an air flow rate in the centrifugal type fan according to FIGS. 14 and 15 and a centrifugal fan having pillars arranged at equal intervals to each other.

FIG. 17 is a view illustrating characteristics between a static pressure and an air flow rate in the centrifugal type fan according to FIGS. 14 and 15 and a centrifugal fan having pillars 7*a* to 7*d* arranged at equal intervals to each other.

In the drawing, a horizontal axis of a graph indicates an air flow rate, and a vertical axis shows a static pressure. In the graph, a dotted line indicates a characteristic of the centrifugal fan according to the background art, and a solid line indicates a characteristic of the centrifugal type fan according to FIGS. 14 and 15.

As shown in FIG. 17, the centrifugal fan according to the illustrative embodiment may obtain a higher static pressure at any air flow rates, when compared to the relation art.

Figure 18:
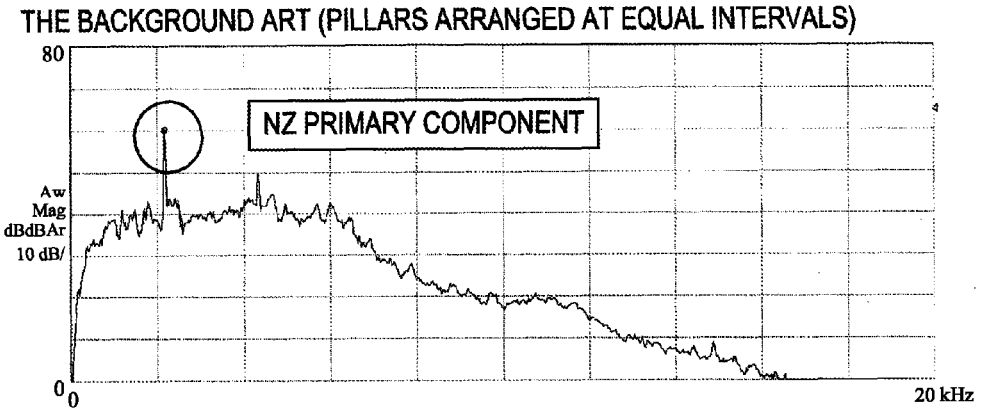
FIG. 18 is a view illustrating a level of noise generated by the centrifugal fan having pillars arranged at equal intervals to each other.
Figure 19:
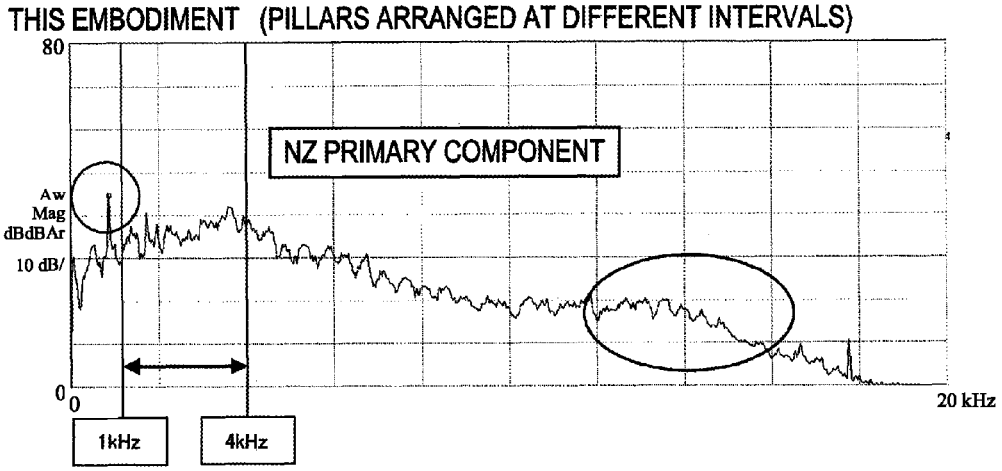
FIG. 19 is a view illustrating a level of noise generated by the centrifugal fan according to the illustrative embodiment shown in FIGS. 14 and 15.

FIG. 18 is a view illustrating a level of noise generated by the centrifugal fan having pillars 7*a* to 7*d* arranged at equal intervals to each other, and FIG. 19 is a view illustrating a level of noise generated by the centrifugal fan according to the illustrative embodiment shown in FIGS. 14 and 15.

In each graph, a horizontal axis indicates a frequency, and a vertical axis indicates a level of noise (in unit of dB (A)) at the corresponding frequency.

According to a noise frequency analysis result of FIG. 18, a significant peak (discrete frequency noise) protruded from a broad band noise exists in a range of frequency from 1 kHz to 4 kHz, which is a important subject of actual audition (i.e., being heard as an evident sound). To the contrary, such a peak is substantially eliminated in a noise frequency analysis result of FIG. 19. Accordingly, by arranging the pillars at different intervals as in the illustrative embodiment, a generation of the discrete frequency noise may be suppressed without degrading an air flow rate characteristic, thereby achieving a noise level lowering of −3 dB(A).

In addition, because of the suppression of the discrete frequency noise, the primary peak level of NZ noise may be reduced, and also the secondary and tertiary harmonic waves may be eliminated. Namely, by suppressing synchronizations of blade passing frequency noises, the primary, secondary and tertiary harmonic waves may be suppressed or eliminated.

Meanwhile, according to FIG. 19, the noise level in higher frequency band (a region surrounded by an ellipse in the drawing) is slightly increased when compared to those of FIG. 18, but this will be a level having no problem. Audio frequency band for human is in a range from 20 Hz to 20 kHz. However, even in the region which the noise level is slightly increased, the level itself is still low and is also significantly different from a range from 1 kHz to 4 kHz which is a frequency band to be easily heard. Further, sounds having a higher frequency band can be blocked when equipped in set devices, thereby rarely causing a substantial problem.

Meanwhile, the number of the pillars is not limited to four, but this discloser can be provided if the number is three or more.

Also, with respect to the intervals between one adjacent pillars, the effects of this discloser can be achieved if at least one interval is different from any another interval. The interval includes at least one of an angle interval and a distance interval.

Meanwhile, the numerical values described in the illustrative embodiment are illustrative ideal numerical values, and thus, even if an error of approximately ±10% is included, the centrifugal fan manufactured will provide the effect of this discloser. For example, the angle θ1 shown in FIG. 16 may be in a range from 76.5 degrees to 93.5 degrees including an error of approximately ±10% with respect to 85 degrees. Similarly, the numerical values, such as the angles and the diameters as described above, may include an error of approximately ±10%.

In addition, the numerical values described in the illustrative embodiment are illustrative ideal numerical values, and this discloser is not limited to the numerical values. The centrifugal fan may have three or more pillars arranged around the impeller. In these cases, an interval between one adjacent pillars of three or more pillars may be different from intervals between the other adjacent pillars. Meanwhile, a plurality of angles θ1, θ1, . . . , θn (wherein n is the number of pillars and n≥3) formed by a plurality of straight lines connecting between the rotation axis of the impeller and each of three or more pillars may preferably be 180 degrees or less. By setting the angles to 180 degrees or less, the upper casing and the lower casing can be more rigidly fixed, and also a vibration of the rotation shaft of the motor can be suppressed. For example, when the number of pillars is three and a plane shape of the casing is formed in a square, the pillars are arranged in each of three corner portions such that the angles are set to θ1=180 degrees, θ2=90 degrees, and θ3=90 degrees, and thus the angles are all set to 0 degree or more and 180 degrees or less. In addition, when the number of pillars is four, and a plane shape of the casing is formed in a square, two pillars is respectively arranged in two corner portions opposite each other, and in one side of two regions defined by a straight line connecting the two pillars, other two pillars can be arranged. As a result, the angles are set to θ1=180 degrees, θ2<90 degrees, θ3<90 degrees, and θ4<90 degrees, and thus the angles are all set to 0 degree or more and 180 degrees or less.

Meanwhile, although the description and drawings of the second illustrative embodiment use the shape of the impeller according to the first illustrative embodiment, the centrifugal fan, which can be achieving a lower noise level without negative effect on an air flow rate characteristic, can be provided, even when the shape of the impeller shown in FIGS. 20 and 21 is used.

The illustrative embodiments described above are to be considered as illustrative examples in all respects and this disclosure is not limited thereto. Various additions, changes, and partial elimination are possible without departing from the conceptual scope and purpose of the present disclosure.

What is claimed is:

1. A centrifugal fan comprising:

a casing including a square shaped lower casing; and a square shaped upper casing having an air inlet opening; and four pillars disposed between the upper casing and the lower casing, wherein air outlet openings are provided between the pillars;

an impeller housed in the casing, wherein the impeller includes an annular upper shroud, a main plate, and a plurality of blades disposed between the annular upper shroud and the main plate; and a fan motor for rotating the impeller, wherein an upper surface of the annular upper shroud faces the upper casing includes a curved surface, wherein each of the pillars is disposed in a vicinity of a corner portion of the casing, and wherein a center of rotation of the impeller is the same with a center of the casing and a plurality of angles formed by a plurality of straight lines connecting between the center of rotation of the impeller and each of the pillars are different from each other.

* * * * *